US009186890B2

(12) United States Patent
Gracia Verdugo et al.

(10) Patent No.: US 9,186,890 B2
(45) Date of Patent: Nov. 17, 2015

(54) DETERMINATION OF A DELAY VALUE IN RESPONSE TO A DETERMINATION THAT A DETECTED TEMPERATURE IS OUTSIDE OF A TARGET TEMPERATURE RANGE

(71) Applicant: Hewlett-Packard Development Company, L.P., Houston, TX (US)

(72) Inventors: Antonio Gracia Verdugo, Barcelona (ES); Gonzalo Gaston Llado, Barcelona (ES); Marta Coma Vives, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/416,281

(22) PCT Filed: Sep. 28, 2012

(86) PCT No.: PCT/US2012/057721
§ 371 (c)(1),
(2) Date: Jan. 22, 2015

(87) PCT Pub. No.: WO2014/051601
PCT Pub. Date: Apr. 3, 2014

(65) Prior Publication Data

US 2015/0202864 A1 Jul. 23, 2015

(51) Int. Cl.
*B41J 29/38* (2006.01)
*B41J 2/045* (2006.01)
*B41J 11/00* (2006.01)

(52) U.S. Cl.
CPC ..... *B41J 2/04573* (2013.01); *B41J 2/04586* (2013.01); *B41J 11/002* (2013.01)

(58) Field of Classification Search
USPC ..... 347/5, 9, 16, 17, 19
See application file for complete search history.

(56) References Cited

U.S. PATENT DOCUMENTS 5,608,439 A 3/1997 Arbeiter et al.
5,992,994 A 11/1999 Rasmussen et al.
6,186,612 B1 * 2/2001 Maeda et al. ..... 347/17

(Continued)

FOREIGN PATENT DOCUMENTS

JP 63098474 4/1988
JP 2010141462 6/2010

OTHER PUBLICATIONS

Lockwood; UV-Lamp Systems Moving-head Digital Inkjet Platforms; Radtech Report; Sep.-Oct. 2004; http://www.uvintegration.com/downloads/files/UV_Lamps_Radtech_2004_97.pdf.

*Primary Examiner* — Lam Nguyen
(74) *Attorney, Agent, or Firm* — Hewlett-Packard Patent Department

(57) ABSTRACT

A method of determining a delay value by an image forming system may include transporting a media along a media transport path by a media transport unit, heating the media by a heating unit, providing a plurality of print passes across the media transport path by a print head assembly, and applying ink to the media to form an image including a plurality of swaths by the print head assembly such that a respective swath is formed on the media corresponding to a respective print pass. The method may also include detecting a temperature of the media by a temperature module to determine whether the detected temperature is outside of a target temperature range, and determining a delay value by a delay determination module in response to a determination that the detected temperature is outside of the target temperature range.

15 Claims, 5 Drawing Sheets

(56) References Cited

U.S. PATENT DOCUMENTS

| | | | | |
|---|---|---|---|---|
| 6,188,422 | B1 | 2/2001 | Ogura | |
| 6,550,883 | B2 | 4/2003 | Oriol | |
| 7,959,247 | B2 * | 6/2011 | Suzuki | 347/16 |
| 2004/0041893 | A1 | 3/2004 | Hoshino | |
| 2005/0088473 | A1 * | 4/2005 | Holstun et al. | 347/17 |
| 2005/0088670 | A1 | 4/2005 | Folkins | |
| 2012/0098882 | A1 | 4/2012 | Onishi et al. | |
| 2012/0162344 | A1 | 6/2012 | Raksha et al. | |

* cited by examiner

DETERMINATION OF A DELAY VALUE IN RESPONSE TO A DETERMINATION THAT A DETECTED TEMPERATURE IS OUTSIDE OF A TARGET TEMPERATURE RANGE

BACKGROUND

An image forming system may include a print head assembly to provide a plurality of print passes across the media transport path. The print head assembly may apply ink to the media to form an image including a plurality of swaths such that a respective swath is formed on the media corresponding to a respective print pass.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

An Image forming system may include a print head assembly to provide a plurality of print passes across the media transport path. The print head assembly may apply ink to the media to form an image including a plurality of swaths such that a respective swath is formed on the media corresponding to a respective print pass. The image forming system may heat the media prior to, during, and/or after forming an image with ink on the media. The ink may include ultraviolet curable ink, latex ink, water-based ink, solvent-based ink, and the like. Periodically, however, the media may not have been sufficiently heated and, thus, the image formed thereon may cause inadequate media to ink adhesion, media distortion, and smudging. For example, when stacked on top of other previously printed media, the image formed on the insufficiently heated media may cause media buckling, rubbing off of portions of the image on other media, and smudge. Image forming systems may also delay the transportation and printing on any portion of the media until the entire media is in a target temperature range. Accordingly, the image quality and throughput of the image forming system producing high quality print jobs may be reduced.

In examples, a method of determining a delay value by an image forming system may include, amongst other things, applying ink to the media to form an image including a plurality of swaths by the print head assembly such that a respective swath is formed on the media corresponding to a respective print pass. The method may also include detecting a temperature of the media by a temperature module to determine whether the detected temperature is outside of a target temperature range, determining a delay value by a delay determination module in response to a determination that the detected temperature is outside of the target temperature range, and providing a delay of an amount of time corresponding to the delay value prior to each move of the print head assembly to perform the respective print pass by a control unit in response to the determination that the detected temperature is outside of the target temperature range. That is, the delay time may be applied in between forming of the respective swaths to complete the image. Thus, the media may be transported and portions thereof may be printed on without waiting for the entire media to reach a target temperature range, while allowing the media to have an appropriate amount of time to be sufficiently heated prior to arriving at a target position. Accordingly, image quality defects and a decrease in throughput of the image forming system in producing high quality print jobs may be reduced.

Figure 1:
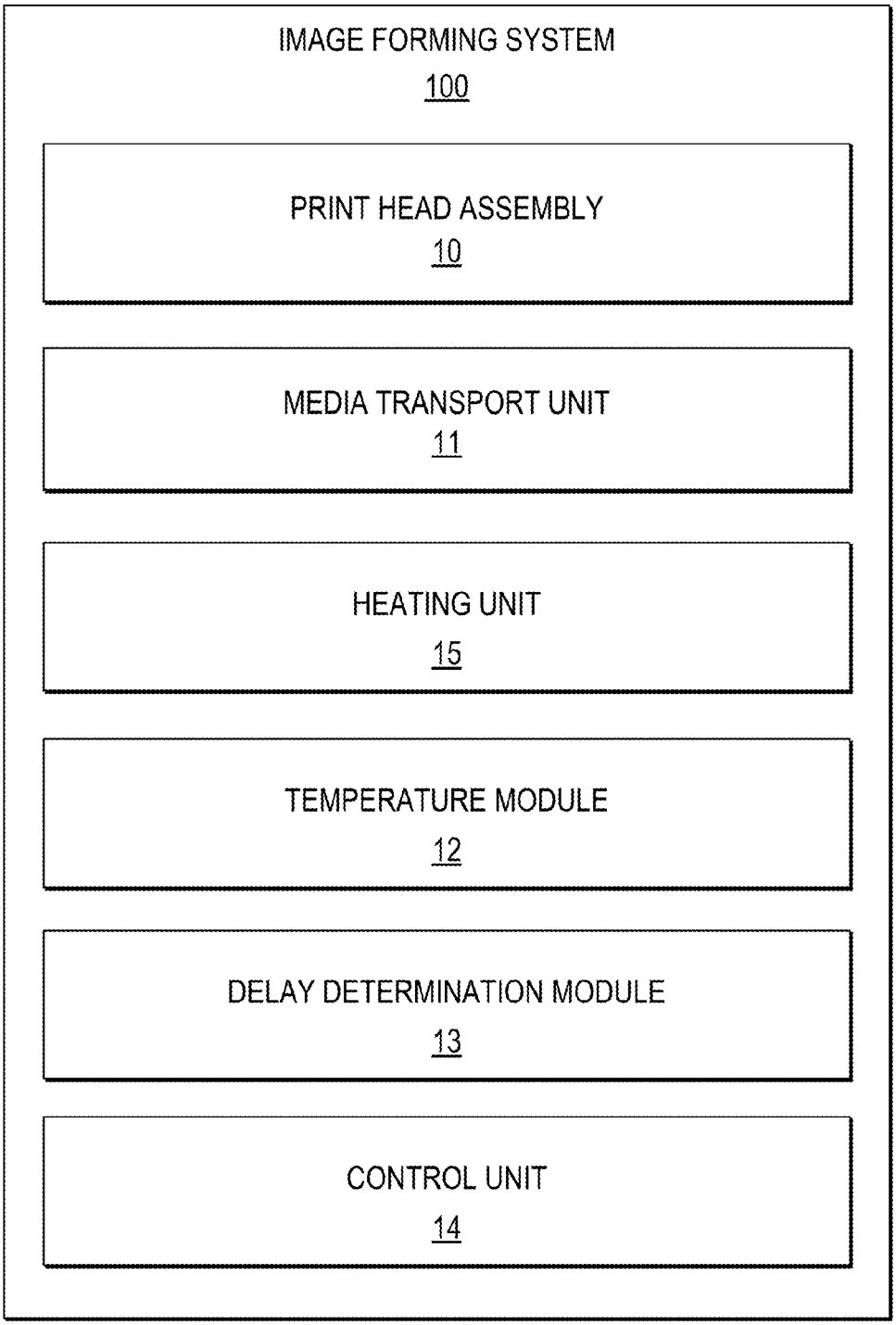
FIG. 1 is a block diagram illustrating an image forming system according to an example.

FIG. 1 is a block diagram illustrating an image forming system according to an example. Referring to FIG. 1, in some examples, an image forming system 100 may include a print head assembly 10, a media transport unit 11, a heating unit 15, a temperature module 12, a delay determination module 13, and a control unit 14. The media transport unit 11 may transport a media along a media transport path 11*a*. The heating unit 15 may heat the media. The print head assembly 10 may provide a plurality of print passes across the media transport path 11*a*. The print head assembly 10 may also apply ink to the media to form an image including a plurality of swaths such that a respective swath is formed on the media corresponding to a respective print pass.

Referring to FIG. 1, in some examples, the temperature module 12 may detect a temperature of the media to determine whether the detected temperature is outside of a target temperature range. If the detected temperature is outside the target temperature range, the delay determination module 13 may determine a delay value. Additionally, if the detected temperature is outside the target temperature range, the control unit 14 may provide a delay by an amount of time corresponding to the delay value between forming each one of the respective swaths on the media by the print head assembly 10. Additionally, in response to the determination that the detected temperature is within the target temperature range, the delay of the amount of time corresponding to the delay value is not provided prior to each moving of the print head assembly 10 to perform the respective print passes by a control unit 14.

Figure 2:
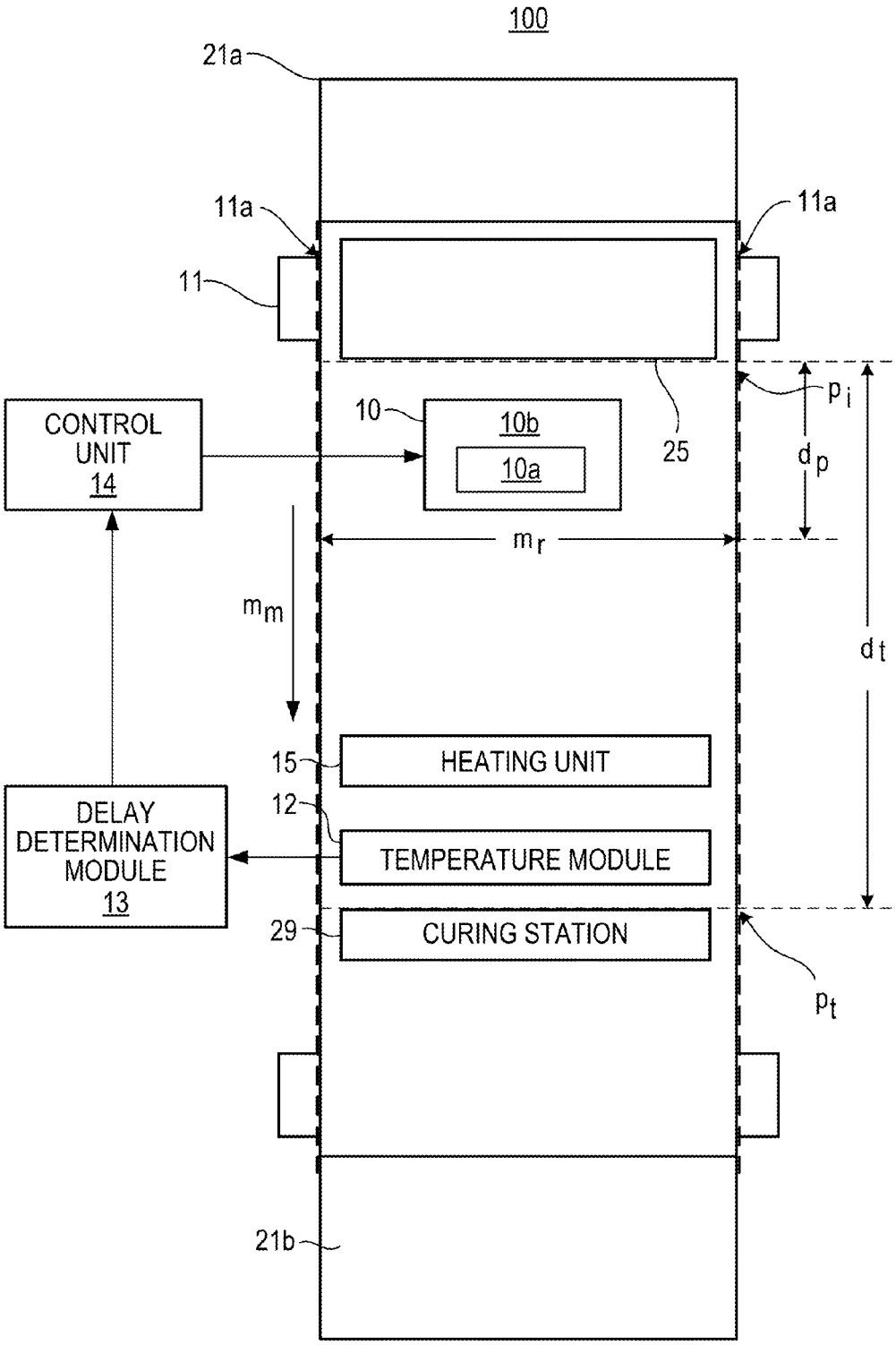
FIGS. 2 and 3 are schematic diagrams illustrating the image forming system of FIG. 1 according to examples.
Figure 3:
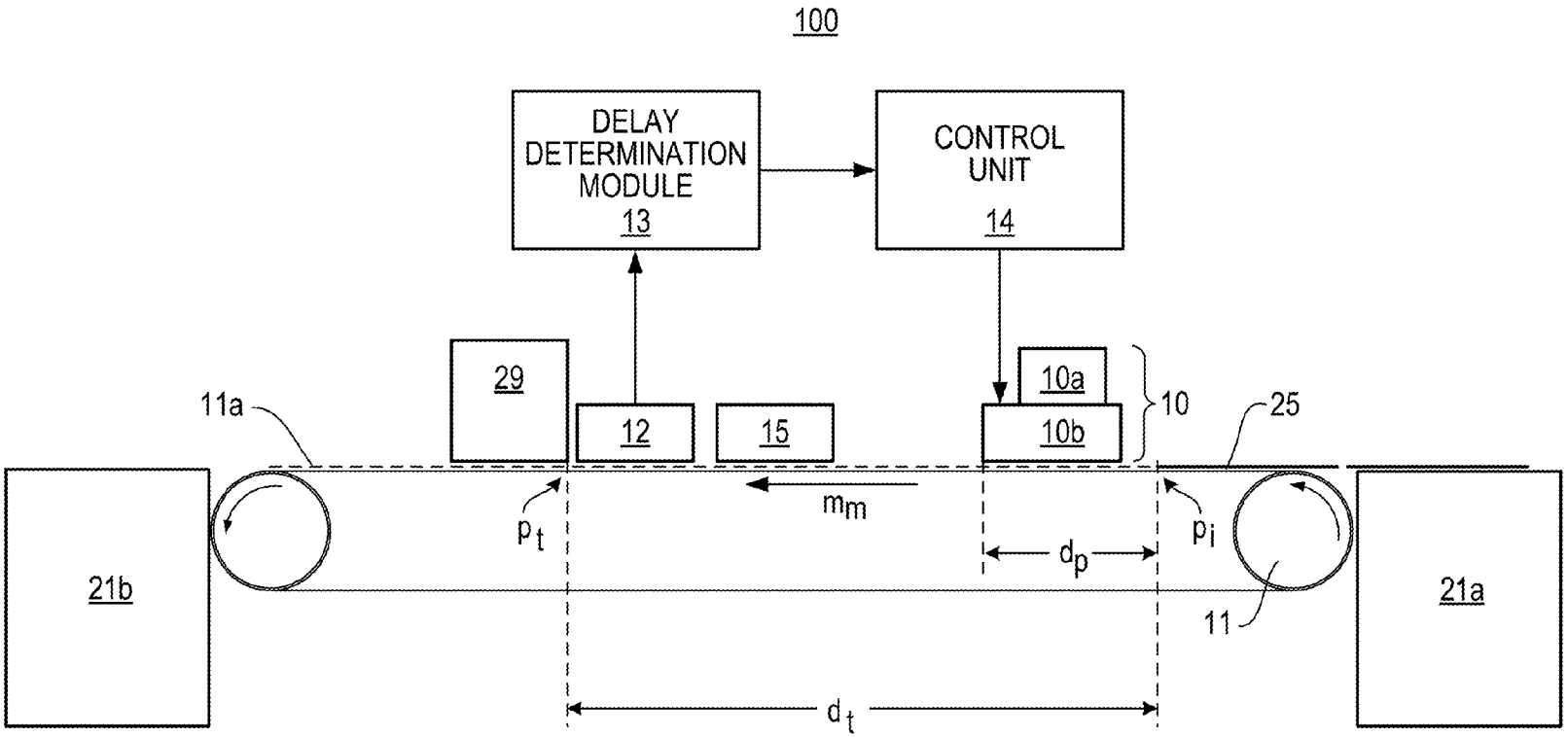

FIGS. 2 and 3 are schematic diagrams illustrating the image forming system of FIG. 1 according to examples. Referring to FIGS. 2 and 3, in some examples, the image forming system 100 may include a print head assembly 10, a media transport unit 11, a heating unit 15, a temperature module 12, a delay determination module 13, and a control unit 14 as previously disclosed with respect to FIG. 1. The image forming system 100 may also include a media supply unit 21*a*, a media collection unit 21*b*, and a curing unit 29. The print head assembly 10 may include a print head 10*a* and a carriage 10*b*. The print head 10*a* may apply ink to the media 25 to form an image including a plurality of swaths. The carriage 10*b* may receive the print head 10*a*. The carriage 10*b* may also move the print head 10*a* across the media transport path 11*a* to perform the respective print passes. That is, the carriage 10*b* may move back and forth across the media transport path 11*a* in a scan direction $m_r$. In some examples, the print head assembly 10 may include a plurality of print heads such as inkjet print heads.

Referring to FIGS. 2 and 3, in some examples, the media transport unit 11 may include motors, servos, rollers, belts, and/or trays, and the like. For example, the media 25 may be supplied by the media supply unit 21*a* and transported along the media path 11*a* in a transport direction $m_m$ by the media transport unit 11 such as a roller and belt system to the media collection unit 21*b*. The media collection unit 21*b* may receive and store the media 25 in a stacked manner from the media transport unit 11. The media 25 may be transported to a print zone for the print head assembly 10 to apply ink to form an image thereon. Subsequently, the media 25 may be transported to a curing unit 29 to cure the image formed of ink on the media 25. In some examples, the curing unit 29 may apply heat and/or ultraviolet radiation onto the image. The media 25 may also be heated by the heating unit 15. In some examples, the image forming system 100 may include a plurality of heating units and/or be pre-heated. At times, the temperature of the media 25 may vary due to, for example, changes in media ink coverage and/or heating unit response time.

Referring to FIGS. 2 and 3, in some examples, the temperature module 12 may detect a temperature of the media 25 to determine whether the detected temperature is outside of a target temperature range. For example, the temperature module 12 may be configured to determine whether the detected temperature is lower than a target temperature value. That is, the target temperature range may be a range equal to and greater than the target temperature value. In other words, the target temperature value may be the lowest temperature value in the target temperature range. The temperature module 12 may include a temperature sensor such as a temperature servo control sensor. In some examples, the temperature module 12 may include a plurality of temperature sensors. The image forming system 100 may also include a plurality of temperature modules.

Referring to FIGS. 2 and 3, in some examples, the control unit 14 may provide a delay of an amount of time corresponding to the delay value between forming each one of the respective swaths. For example, the control unit 14 may provide the delay of the amount of time corresponding to the delay value prior to moving the carriage 10*b* to enable the at least one print head 10*a* to perform the respective print passes. Thus, the delay value may be a dynamic inter-swath dry time to provide time between forming each swath for the media 25 to reach the target temperature when the media reaches its target position $p_t$. For example, the target position $p_t$ may be a position at the entrance of the curing station 29. Additionally, in response to the determination that the detected temperature is within the target temperature range, the delay of the amount of time corresponding to the delay value may not be provided prior to each moving of the print head assembly 10 to perform the respective print passes by a control unit 14.

Referring to FIGS. 2 and 3, in some examples, the delay determination module 13 may be configured to determine the delay value based on at least one of a temperature difference corresponding to a difference between the target temperature value and the detected temperature of the media 25, a target media travel distance corresponding to a distance for the media 25 to travel from an initial position $p_i$ to a target position $p_t$, an intermediate media travel distance corresponding to a distance for the media 25 to travel during a respective print pass of the print head assembly 10, and a constant. For example, the constant may correspond to a rate of temperature change over time of the media 25 with respect to a number of print passes. In some examples, the constant may be based on the type of media, type of ink, amount of ink coverage of the media, and/or number of print passes. The initial position $p_i$ may correspond to a respective position of the media 25 at a time when the temperature of the media 25 is detected. The delay determination module 13, for example, may be configured to determine the delay value based on the temperature difference, the target media travel distance, the intermediate media travel distance, and the constant.

In some examples, the delay value may be determined by Equation One.

$$V_d = A(t_t - t_d)/(d_t/d_p), \text{ wherein,} \qquad \text{EQUATION ONE:}$$

$V_d$ is the delay value;

A is a constant;

$t_t$ is a target temperature value, $t_d$ is the detected temperature of the media;

$d_t$ is a distance for the media to travel from an initial position to a target position (e.g., target media travel distance); and $d_p$ is a distance for the media to travel during a respective print pass of the print head assembly (e.g., intermediate media travel distance).

For illustrative purposes, the following example is provided in which a target temperature range is in a range equal to and greater than a target temperature value of 40° C. The temperature module 12 detects a temperature $t_d$ of the media 25 of 38° C. Thus, the respective temperature difference is 2° C. The initial position $p_i$ of the media 25 is the current media position at the time the respective detected temperature $t_d$ of the media 25 is identified. The target position $p_t$ of the media 25 is a position corresponding to an entrance to the curing unit 29 which is 1 meter away from the initial position $p_i$ of the media 25. Thus, the target media travel distance $d_t$ is 1 meter. That is, the distance $d_t$ for the media 25 to travel along the media transport path 11*a* in the media transport direction $m_m$ from the initial position $p_i$ to the target position $p_t$ is 1 meter. Also, during the time for the print head assembly 10 to perform a print pass, the media 25 may travel 0.1 meters along the media path 11*a* in a media transport direction $m_m$. Thus, the intermediate media travel distance $d_p$ is 0.1 meters.

Further, a constant A may be 10 (meters)(second)/° C. In some examples, the constant may correspond to a rate of temperature change over time of the media 25 with respect to a number of print passes. Accordingly, the delay time to be used between forming of each one of the respective swaths is calculated to be 2 seconds until another determination of the delay time is completed based upon new current values. In some examples, as iterations of delay time determinations are calculated, the delay time may approach zero. Thus, the delay time may be dynamically determined in real-time resulting in the determination of a dynamic and variable inter-swath dry time to enable enough time for the temperature of the media 25 to reach the target temperature $t_t$ by the time the media 25 reaches the target position $p_t$.

In some examples, the temperature module 12, the delay determination module 13, and/or the control unit 14 may be implemented in hardware, software including firmware, or combinations thereof. The firmware, for example, may be stored in memory and executed by a suitable instruction-execution system. If implemented in hardware, as in an alternative example, the temperature module 12, the delay determination module 13, and/or the control unit 14 may be implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In other examples, the temperature module 12, the delay determination module 13, and/or the control unit 14 may be implemented in a combination of software and data executed and stored under the control of a computing device.

Figure 4:
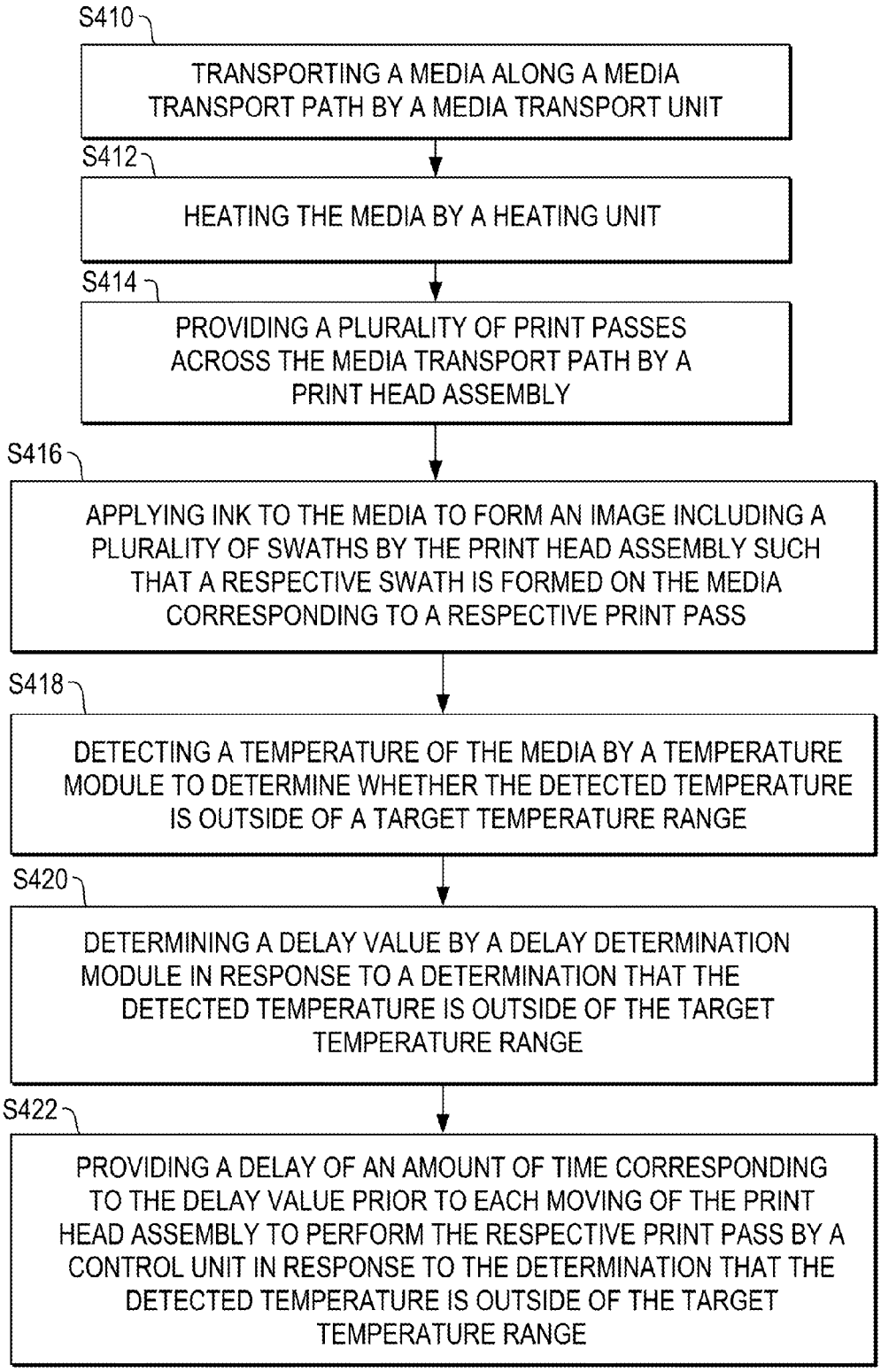
FIG. 4 is a flowchart illustrating a method of determining a delay value by an image forming system according to an example.

FIG. 4 is a flowchart illustrating a method of determining a delay value by an image forming system according to an example. Referring to FIG. 4, in block S410, a media is transported along a media transport path by a media transport unit. In block S412, the media is heated by a heating unit. In block S414, a plurality of print passes is provided across the media transport path by a print head assembly. In block S416, ink is applied to the media to form an image including a plurality of swaths by the print head assembly such that a respective swath is formed on the media corresponding to a respective print pass. In block S418, a temperature of the media is detected by a temperature module to determine whether the detected temperature is outside of a target temperature range. In block S420, a delay value is determined by a delay determination module in response to a determination that the detected temperature is outside of the target temperature range.

In block S422, a delay of an amount of time corresponding to the delay value is provided prior to each moving of the print head assembly to perform the respective print passes by a control unit in response to the determination that the detected temperature is outside of the target temperature range. That is, the ink may be applied to the media to form the image including the plurality of swaths by at least one print head and the at least one print head may be received by a carriage to move the at least one print head across the media transport path to perform the respective print passes. For example, a delay of an amount of time corresponding to the delay value may be provided by the control unit between forming each one of the respective swaths on the media by the print head assembly. In some examples, a determination of whether the detected temperature is outside the target temperature range may be based on whether the detected temperature is lower than a target temperature value.

In some examples, the determination of the delay value by the delay determination module may be based on at least one of a temperature difference corresponding to a difference between the target temperature value and the detected temperature of the media, a target media travel distance corresponding to a distance for the media to travel from an initial position to a target position, an intermediate media travel distance corresponding to a distance for the media to travel during a respective print pass of the print head assembly, and a constant. For example, the constant may correspond to a rate of temperature change over time of the media with respect to a number of print passes. In some examples, the determination of the delay value may be based on the temperature difference, the target media travel distance, the intermediate media travel distance, and the constant. For example, the delay value may be determined by Equation One previously disclosed. Alternatively, in response to the determination that the detected temperature is within the target temperature range, the delay of the amount of time corresponding to the delay value is not provided prior to each moving of the print head assembly to perform the respective print passes by a control unit.

Figure 5:
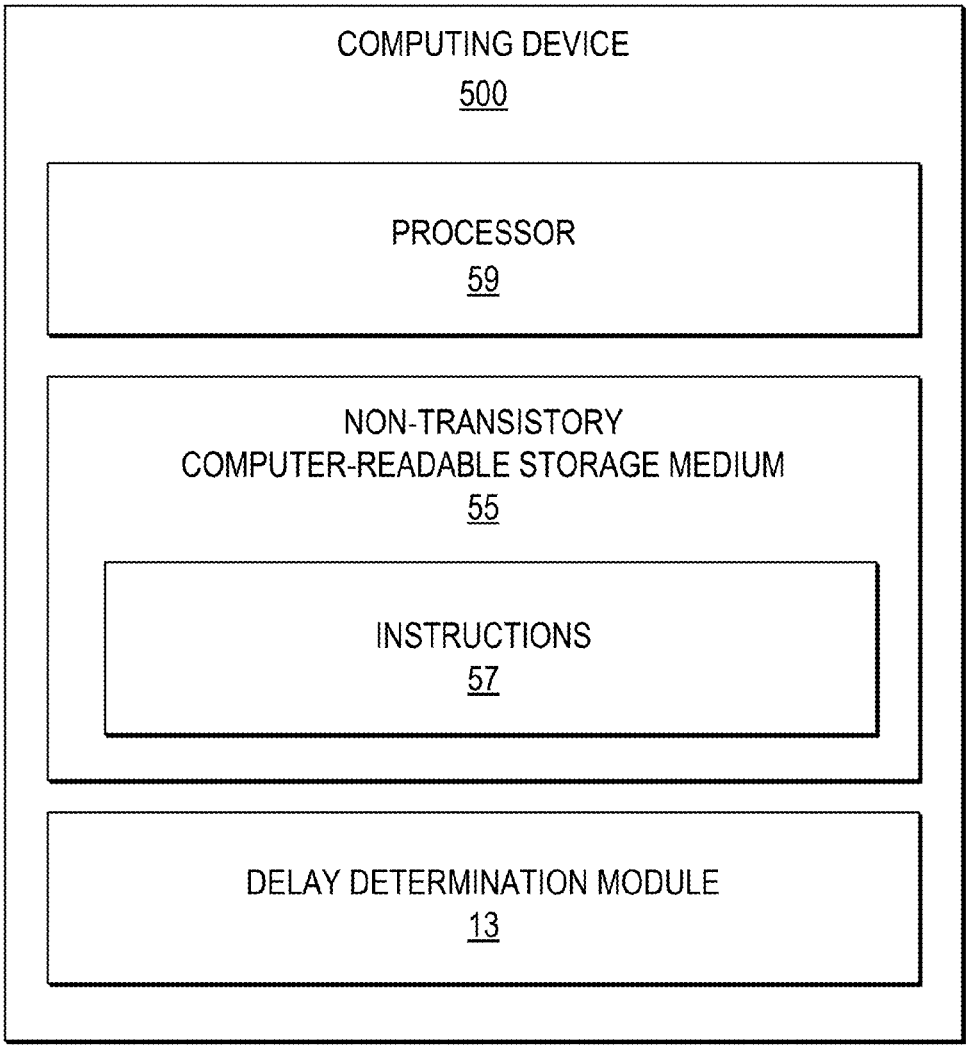
FIG. 5 is a block diagram illustrating a computing device such as an image forming system including a processor and a non-transitory, computer-readable storage medium to store instructions to operate the image forming system to determine a delay value according to an example.

FIG. 5 is a block diagram illustrating a computing device such as an image forming system including a processor and a non-transitory, computer-readable storage medium to store instructions to operate an image forming system to determine a delay value according to an example. Referring to FIG. 5, in some examples, the non-transitory, computer-readable storage medium 55 may be included in a computing device 500 such as an image forming system including a delay determination module 13. In some examples, the non-transitory, computer-readable storage medium 55 may be implemented in whole or in part as instructions 57 such as computer-implemented instructions stored in the computing device locally or remotely, for example, in a server or a host computing device considered herein to be part of the image forming system.

Referring to FIG. 5, in some examples, the non-transitory, computer-readable storage medium 55 may correspond to a storage device that stores instructions 57, such as computer-implemented instructions and/or programming code, and the like. For example, the non-transitory, computer-readable storage medium 55 may include a non-volatile memory, a volatile memory, and/or a storage device. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM).

Referring to FIG. 5, examples of storage devices include, but are not limited to, hard disk drives, compact disc drives, digital versatile disc drives, optical drives, and flash memory devices. In some examples, the non-transitory, computer-readable storage medium 55 may even be paper or another suitable medium upon which the instructions 57 are printed, as the instructions 57 can be electronically captured, via, for instance, optical scanning of the paper or other medium, then compiled, interpreted or otherwise processed in a single manner, if necessary, and then stored therein. A processor 59 generally retrieves and executes the instructions 57 stored in the non-transitory, computer-readable storage medium 55, for example, to operate a computing device 500 such as an image forming system to determine a delay value in accordance with an example. In an example, the non-transitory, computer-readable storage medium 55 can be accessed by the processor 59. The delay determination module 13 may determine a delay value in response to a determination that a detected temperature is outside of a target temperature range.

It is to be understood that the flowchart of FIG. 4 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 4 illustrates a specific order of execution, the order of execution may differ from that which is depicted. For example, the order of execution of two or more blocks may be scrambled relative to the order illustrated. Also, two or more blocks illustrated in succession in FIG. 4 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A method of determining a delay value by an image forming system, the method comprising:

transporting a media along a media transport path by a media transport unit;

heating the media by a heating unit;

providing a plurality of print passes across the media transport path by a print head assembly;

applying ink to the media to form an image including a plurality of swaths by the print head assembly such that a respective swath is formed on the media corresponding to a respective print pass;

detecting a temperature of the media by a temperature module to determine whether the detected temperature is outside of a target temperature range;

determining a delay value by a delay determination module in response to a determination that the detected temperature is outside of the target temperature range; and providing a delay of an amount of time corresponding to the delay value prior to each moving of the print head assembly to perform the respective print pass by a control unit in response to the determination that the detected temperature is outside of the target temperature range.

2. The method according to claim 1, wherein the providing a delay of an amount of time corresponding to the delay value prior to the moving of the print head assembly to perform the respective print pass by a control unit further comprises:

providing the delay of the amount of time corresponding to the delay value by the control unit between forming each one of the respective swaths on the media by the print head assembly.

3. The method according to claim 1, wherein the providing a delay of an amount of time corresponding to the delay value prior to each moving of the print head assembly to perform the respective print pass by a control unit further comprises:

applying the ink to the media to form the image including the plurality of swaths by at least one print head; and receiving the at least one print head by a carriage to move the at least one print head across the media transport path to perform the respective print passes.

4. The method according to claim 1, wherein the determining the delay value by the delay determination module further comprises:

determining the delay value based on at least one of a temperature difference corresponding to a difference between a target temperature value and the detected temperature of the media, a target media travel distance corresponding to a distance for the media to travel from an initial position to a target position, an intermediate media travel distance corresponding to a distance for the media to travel during a respective print pass of the print head assembly, and a constant.

5. The method according to claim 4, wherein the determining the delay value by the delay determination module further comprises:

determining the delay value based on the temperature difference, the target media travel distance, the intermediate media travel distance, and the constant.

6. The method according to claim 1, wherein the delay value is determined by a following equation:

$$V_d = A(t_t - t_d)/(d_t/d_p), \text{ wherein}$$

$V_d$ is the delay value;

A is a constant;

$t_t$ is a target temperature value;

$t_d$ is the detected temperature of the media;

$d_t$ is a distance for the media to travel from an initial position to a target position; and $d_p$ is a distance for the media to travel during a respective print pass of the print head assembly.

7. The method according to claim 6, wherein the initial position corresponds to a respective position of the media at a time when the temperature of the media is detected.

8. An image forming system, comprising:

a media transport unit to transport a media along a media transport path;

a heating unit to heat the media;

a print head assembly to provide a plurality of print passes across the media transport path, the print head assembly to apply ink to the media to form an image including a plurality of swaths such that a respective swath is formed on the media corresponding to a respective print pass;

a temperature module to detect a temperature of the media to determine whether the detected temperature is outside of a target temperature range;

a delay determination module to determine a delay value in response to a determination that the detected temperature is outside of the target temperature range; and a control unit to provide a delay of an amount of time corresponding to the delay value between forming of each one of the respective swaths on the media by the print head assembly in response to the determination that the detected temperature is outside of the target temperature range.

9. The image forming system according to claim 8, wherein the print head assembly further comprises:

at least one print head to apply the ink to the media to form the image including the plurality of swaths; and a carriage to receive the at least one print head, the carriage to move the at least one print head across the media transport path to perform the respective print passes.

10. The image forming system according to claim 9, wherein the control unit to provide a delay of an amount of time corresponding to the delay value between forming each one of the respective swaths further comprises:

the control unit to provide the delay of the amount of time corresponding to the delay value prior to moving the carriage to enable the at least one print head to perform the respective print passes.

11. The image forming system according to claim 8, wherein the delay determination module is configured to determine the delay value based on at least one of a temperature difference corresponding to a difference between a target temperature value and the detected temperature of the media, a target media travel distance corresponding to a distance for the media to travel from an initial position to a target position, an intermediate media travel distance corresponding to a distance for the media to travel during a respective print pass of the print head assembly, and a constant.

12. The image forming system according to claim 11, wherein the delay determination module is configured to determine the delay value based on the temperature difference, the target media travel distance, the intermediate media travel distance, and the constant.

13. The image forming system according to claim 8, wherein the delay value is determined by a following equation:

$V_d = A(t_t - t_d)/(d_t/d_p)$, wherein $V_d$ is the delay value;

A is a constant;

$t_t$ is a target temperature value;

$t_d$ is the detected temperature of the media;

$d_t$ is a distance for the media to travel from an initial position to a target position; and $d_p$ is a distance for the media to travel during a respective print pass of the print head assembly.

14. The image forming system according to claim 13, wherein the initial position corresponds to a respective position of the media at a time when the temperature of the media is detected.

15. A non-transitory computer-readable storage medium having computer executable instructions stored thereon to operate an image printing system to determine a delay value, the instructions are executable by a processor to:

transport a media along a media transport path by a media transport unit;

heat the media by a heating unit;

provide a plurality of print passes across the media transport path by a print head assembly;

apply ink to the media to form an image including a plurality of swaths by the print head assembly such that a respective swath is formed on the media corresponding to a respective print pass;

detect a temperature of the media by a temperature module to determine whether the detected temperature is outside of a target temperature range;

determine the delay value by a delay determination module in response to a determination that the detected temperature is outside of the target temperature range; and provide a delay of an amount of time corresponding to the delay value between forming each one of the respective swaths on the media by the print head assembly in response to the determination that the detected temperature is outside of the target temperature range.

* * * * *